US006612045B2

(12) United States Patent
Kruskamp

(10) Patent No.: US 6,612,045 B2
(45) Date of Patent: Sep. 2, 2003

(54) APPARATUS AND METHOD FOR SPACING TILES

(76) Inventor: Stephen L Kruskamp, 7212 Walnut Rd., Fair Oaks, CA (US) 95628

( * ) Notice: Subject to any disclaimer, the term of this patent is extended or adjusted under 35 U.S.C. 154(b) by 0 days.

(21) Appl. No.: 09/800,297

(22) Filed: Mar. 5, 2001

(65) Prior Publication Data

US 2002/0121027 A1 Sep. 5, 2002

(51) Int. Cl.[7] ..... G01B 3/30
(52) U.S. Cl. ..... 33/526; 33/645; 33/DIG. 20
(58) Field of Search ..... 33/1 F, 1 G, 474, 33/481, 518, 526, 527, 613, 645, DIG. 20; 52/747.11, 747.12

(56) References Cited

U.S. PATENT DOCUMENTS

| | | | | | |
|---|---|---|---|---|---|
| 2,930,135 | A | | 3/1960 | Rodtz Sr., et al. | 33/518 |
| 3,735,497 | A | | 5/1973 | Boettcher | 33/526 |
| 3,775,856 | A | * | 12/1973 | Schmidt | 33/518 |
| 4,793,068 | A | | 12/1988 | Golkar | 33/526 |
| 4,953,341 | A | * | 9/1990 | Joos | 33/DIG. 20 |
| 4,955,142 | A | * | 9/1990 | Rieck | 33/526 |
| 5,201,130 | A | * | 4/1993 | Krchnak | 33/526 |
| 5,288,534 | A | * | 2/1994 | Tavshanjian | 33/DIG. 20 |
| 5,359,783 | A | * | 11/1994 | Smith | 33/526 |
| 5,768,793 | A | * | 6/1998 | Fields | 33/526 |
| 5,832,619 | A | * | 11/1998 | Volkema, Jr. | 33/527 |

* cited by examiner

*Primary Examiner*—G. Bradley Bennett

(57) ABSTRACT

A tile spacer is provided which can be used to create consistent gaps between tiles in a tile floor installation. The spacer is in the form of a cross having a center and four arms extending outwardly from said center with each arm positioned at an angle of about ninety degrees from each adjacent arm, and each arm has a predetermined width for forming a space of desired width between adjacent tiles placed on a substantially flat, adhesive-coated surface which will be subsequently filled with grout, and a groove of predetermined shape connecting the diagonally opposed intersections between the arms forms a raised bead in the adhesive for providing further support for the tiles and grout once the adhesive cures. The shape of the tile spacer allows it to be used between adjacent tiles in the first course of tiles laid along a chalk line or straight edge, as well as in the intersections formed between each group of four tiles as subsequent courses of tiles are laid, and a handle allows easy subsequent removal once the adhesive has set or cured.

37 Claims, 3 Drawing Sheets

APPARATUS AND METHOD FOR SPACING TILES

TECHNICAL FIELD OF THE INVENTION

This invention relates generally to floor and wall installation, and more particularly to the construction of tiled floors and walls.

BACKGROUND OF THE INVENTION

Tiles have been used since ancient times to produce decorative and highly attractive floors and walls. Tiles are also quite useful in producing surfaces which are waterproof or highly water-resistant, and easy to clean, and therefore very desirable for bathrooms and kitchens.

Some of the most beautiful tile work is formed from irregular pieces of tile or glass set by hand by artists to form mosaics of incredible detail. However, such works are very time consuming to produce, and are therefore well beyond the means of most consumers. Accordingly, most tile floors and walls are installed as quickly as possible, using standard rectangular tiles. Not infrequently, consumers themselves will attempt tile installation with little or no prior instruction to keep costs down.

Tile installation is fairly straight forward. The surface to be tiled is cleaned to remove any bumps or surface irregularities, so that a substantially clean, flat surface is produced. The surface is coated with a slow-curing adhesive composition, referred to in the trade as "mud." A straight edge, chalk line or laser is used at one edge of the surface for aligning the first row of tiles, then the remaining tiles are aligned with respect to the first row of tiles. When it is desired to shift Each tile is spaced away from each adjacent tile by a desired gap. Once the mud is cured, the gap between the tiles is filled with grout. When complete, the lines of grout most desirably produce straight lines of consistent width. Getting the tiles aligned so that the grout in the finished installation is straight and of consistent width is clearly the most difficult and time consuming task, and is the most frequent cause of a poor or unacceptable looking tile installation.

Accordingly, the need exists for a tile spacer which can be used with ease by a skilled worker or an amateur to produce a tiled floor or wall which looks like a professional installation.

SUMMARY OF THE INVENTION

In one embodiment, the present invention provides a spacer for aligning tiles with respect to each other, the spacer having a spacer body and a handle for pushing the spacer body into, and removing the spacer body from, the gap between adjacent tiles, the spacer in the form of a cross of predetermined thickness made from a material sufficiently rigid to prevent substantial deformation by the tiles, the cross having a center and four arms extending outwardly from the center, each arm positioned at an angle of substantially ninety degrees from each adjacent arm, each said arm having a predetermined width equal to the desired spacing between adjacent tiles, each said arm having a bottom surface with a substantially flat portion for engaging the substantially flat surface to be tiled, each said arm also having a first side surface in a plane perpendicular to the bottom surface and a second side surface opposite said first side surface also in a plane perpendicular to the bottom surface, the first and second side surfaces having a substantially flat portion for engaging and aligning the facing edges of adjacent tiles.

In yet another embodiment, the present invention provides a spacer for aligning tiles with respect to each other, the spacer having a spacer body in the form of a cross of predetermined thickness made from a material sufficiently rigid to prevent substantial deformation by the tiles, the cross having a center and four arms extending outwardly from the center, each arm positioned at an angle of substantially ninety degrees from each adjacent arm, each said arm having a predetermined width equal to the desired spacing between adjacent tiles, each said arm having a bottom surface with a substantially flat portion for engaging the substantially flat surface to be tiled, and a groove connecting diagonally opposed intersections between adjacent arms through said center for forming a raised bead of predetermined shape in an adhesive layer in which the tiles are laid during the construction of the tile floor. A handle may be provided to permit easy insertion and removal of the spacer, and manipulation of the tiles while the adhesive remains workable.

In yet another embodiment, the present invention includes a method for installing tiles using a tile spacer of the present invention;

In yet another embodiment, the present invention includes a point of sale display for displaying a variety of different sizes of tile spacers to consumers who wish to attempt a tile floor installation without professional assistance, the tile spacers being color coded so that consumers can select the tile spacer which will produce the desired spacing between adjacent tiles by selecting tile spacers of the correct color.

Other and further objects, features, advantages and embodiments of the present invention will become apparent to one skilled in the art from reading the Detailed Description of the Invention together with the drawings.

DETAILED DESCRIPTION OF THE INVENTION

Figure 1:
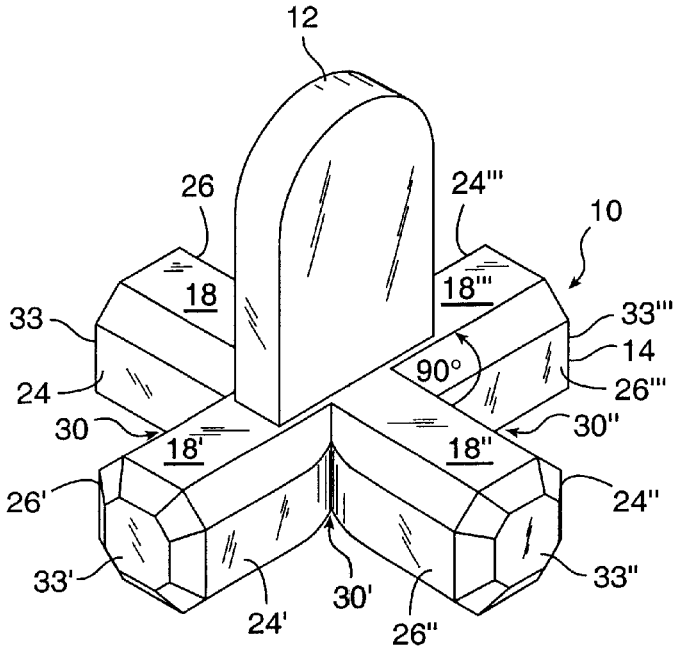
FIG. 1 is a perspective top view of a tile spacer of the present invention.

A tile spacer of the present invention is used to provide accurate spacing between tiles in a tile floor construction formed by laying the tiles in a layer of adhesive, and, once the adhesive has set or cured, adding grout to a level flush or substantially so with the top surface of the tile. The term "adhesive" as used herein means any adhesive composition used to lay tile, such as, for example, thin set, mortar or mastic.

As shown in FIGS. 1–5, a tile spacer of the present invention preferably comprises a spacer body 10 and a handle 12. Spacer body 10 is in the form of a cross of predetermined thickness or height 14 which will enable the handle 12 to extend above the surface of the tiles when the spacer body 10 is inserted between adjacent tiles during installation of a tile floor or wall. Handle 12 also allows the installer to shift and move tiles which may have become misaligned to place them in more accurate alignment while the adhesive is still wet or workable. The spacer body 10 and handle 12 are most preferably formed as a single piece, for example, by molding or machining. However, it would also be possible to form the spacer body 10 with a connector or other engagement means which would permit a handle 12 to be removably connected to the spacer body 10.

Spacer body 10 has a center 16 and four arms 18, 18', 18", 18'" which extend outwardly from center 16 with each arm positioned at an angle of about ninety (90) degrees from each adjacent arm. Each arm 18, 18', 18", 18'" has a substantially flat bottom surface 22, 22', 22", 22'" for engaging a layer of adhesive on a substantially flat surface to be tiled. In addition, each arm has an end surface 33, 33', 33", 33'", a first side surface 24, 24', 24", 24'" and a second side surface 26, 26', 26", 26'". First side surfaces 24, 24', 24", 24'" and second side surface s 26 , 26', 26", 26'" include at least a portion which is substantially flat for engaging and aligning the flat edges of the tiles during installation. While the arms 18, 18', 18", 18'" may be generally rectangular in cross-section, they are more preferably bevelled as shown most clearly in FIGS. 3 and 4, to provide guiding surfaces to enable the tile spacer to easily slide into place past rigid, sharp tile edges during installation and to force apart adjacent tiles which are spaced too closely together. The bevelled surfaces preferably include surfaces between each bottom surface and adjacent side surfaces, such as, for example, bevelled surface 28*a*'" between the bottom surface 22'" and first side 24'" and bevelled surface 28*b*'" between bottom surface 22'" and second side 26'" shown in FIG. 4. The end of each arm 18, 18', 18", 18'" may also be bevelled as shown in FIG. 5.

Figure 2:
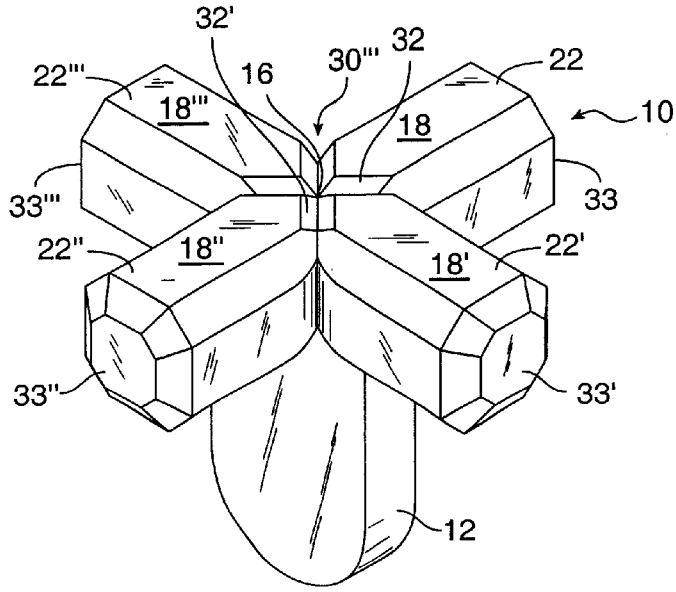
FIG. 2 is a perspective bottom view of a tile spacer of the present invention.
Figure 3:
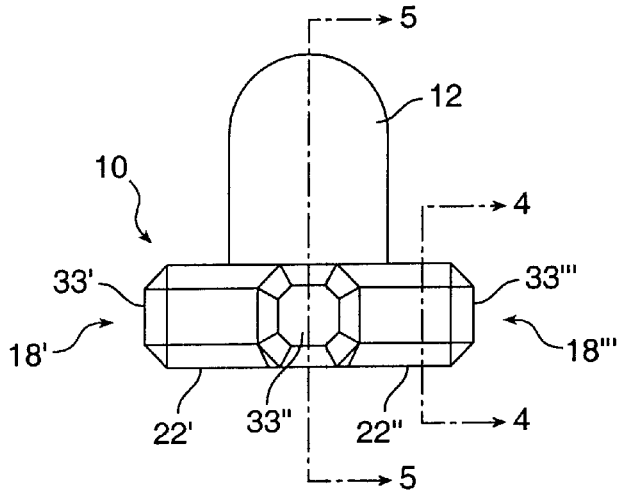
FIG. 3 is a side view of a tile spacer of the present invention.
Figure 5:
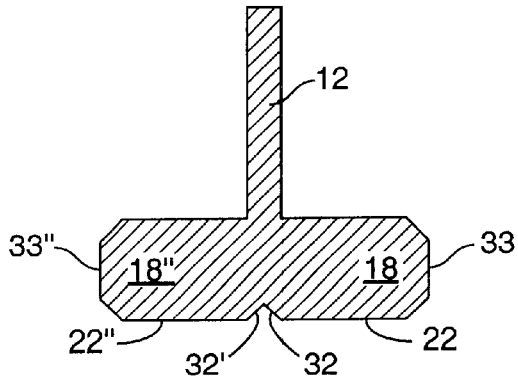
FIG. 5 is a cross-section taken through line 5—5 of FIG. 3.

A first shaped groove 32 and a second shaped groove 32' (preferably "v" or "u" shaped grooves), shown in FIGS. 2 and 5, are also most preferably provided to connect diagonally opposed intersections between the arms 18, 18', 18", 18'". Preferably, these grooves produce a raised, shaped bead of adhesive between the tiles which provides an additional molded structure which more readily holds the tiles and prevents their displacement prior to grouting, and also provides an additional molded structure for securely holding the grout. This raised bead of adhesive also helps create a stronger joint between the corners of adjacent tiles. As shown in FIG. 2, the shaped grooves 32, 32' intersect in the center of the spacer body 10 to form a cross shape that is radially offset from the cross shaped spacer body by forty five degrees (45°). Accordingly, when the tile spacer is removed from the adhesive it leaves a raised cross-shaped pattern in the adhesive between the corners of adjacent tiles.

Figure 4:
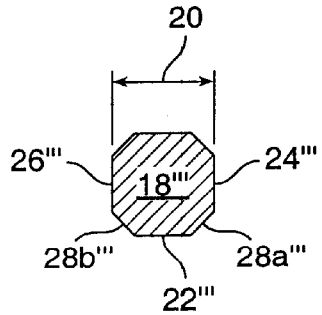
FIG. 4 is a cross-section taken through line 4—4 of FIG. 3.
Figure 6A:
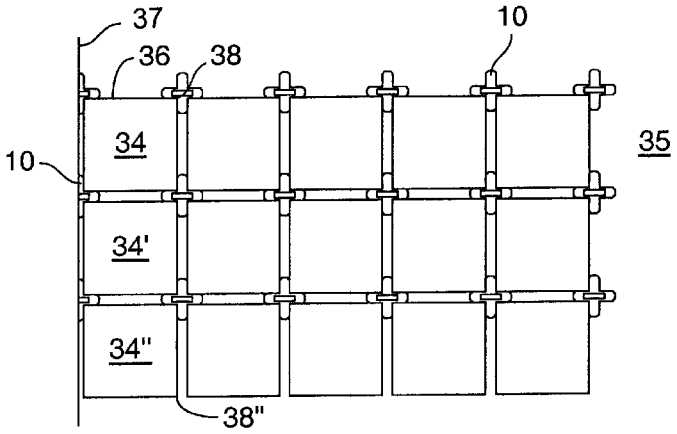
FIG. 6*a* is a top view of a tile installation showing the use of tile spacers of the present invention to create uniformly even spacing between tiles.
Figure 6B:
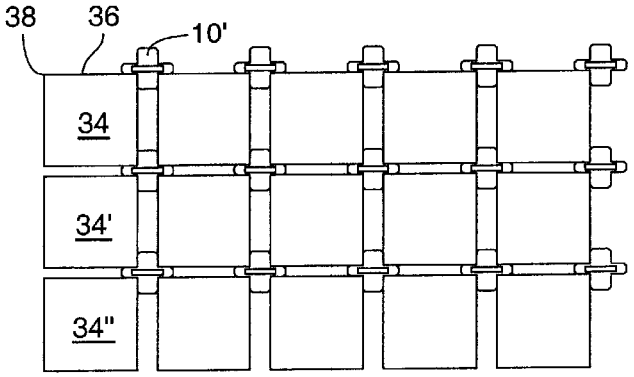
FIG. 6*b* is a top view of a tile installation showing the use of tile spacers of the present invention to create one width of spacing between tiles in one direction and a second, different width of spacing between tiles in a perpendicular direction; and, FIG. 7 is a front view of a consumer display showing a preferred method of displaying for sale tile spacers of the present invention.

It will be immediately apparent that the distance between the first and second side surface of each arm defines the width 20 of each arm (see, for example, FIG. 4). Width 20 sets the spacing between adjacent tiles which will subsequently filled with grout. The desired spacing between adjacent tiles will vary from installation to installation, and will depend, in large part, on the personal preferences of the installer or consumer, and on the size of the tiles to be installed. Generally, larger spacing is desirable for larger tiles, and smaller spacing for smaller tiles. Therefore, the size of a tile spacer of the present invention, and more importantly, of the width 20 of the arms of a tile spacer of the present invention, may be modified to produce predetermined spaces of a variety of sizes which will be suitable for a wide range of different size tiles. While most consumers appear to prefer that the predetermined space between tiles be a consistent size throughout the installation, it is possible that some consumers might wish for the grout to form horizontal lines of one thickness and vertical lines of a different thickness. For such an installation it would, of course, be possible to provide a tile spacer having a first arm thickness for two arms aligned along a common axis, and a second arm thickness for the remaining two arms which are perpendicular. The use of such a spacer would, of course, be slightly more complex for an amateur to use, since it would require the amateur to orient the spacer correctly before inserting it between adjacent tiles. For an example of such an installation, see FIG. 6*b*.

The intersection 30, 30', 30", 30'" between the arms, shown in FIGS. 1 and 2, preferably do not form rigid ninety (90) degree angles, but are slightly radiused (or cut away) to form a concavity to avoid any interference with the sharp corner of a tile so that the intersection can be easily slipped over the sharp corner of a tile as the tile spacer is used to adjust the spacing between adjacent tiles. It should be appreciated that this cut-away concavity at the intersection 30 of the spacer arms provides a means of fortifying the foundation under the tips of the tile which increases the strength. This is in contrast to the insertion of a conventional spacer that without the concavity would naturally force adhesive material away from the periphery of the corner, wherein the subsequently applied grout must then be relied upon to support the tips of the tile. Upon inserting the spacer onto an adhesive layer, the concavity within the spacer operates to build material both under and alongside, the corners of the tile to increase adhesion of the tile to the surface upon which is being attached.

A tile spacer of the present invention is preferably made of a material which is sufficiently rigid to avoid deformation when pressed between adjacent tiles, and sufficiently smooth to allow the surfaces of the tile spacer to contact and easily slide past the relatively rough surface edges of the tile. Acceptable materials include injection molded stiff silicone, plastic, ceramic, glass, or metals such as steel or aluminum. I particularly prefer injection molded silicone which can be provided in a variety of different colors for color coding different sizes of tile spacers. Moreover, it is preferred that the spacer body 10 and handle 12 be cast as a single, unitary structure. This prevents the handle 12 becoming inadvertently detached during removal of the tile spacer body 10 after the tile structure has been completely installed and during or after curing of the adhesive composition or "mud".

To use tile spacer of the present invention, one first determines the width of the space which is desired between the adjacent tiles of the installation, based upon personal preference and the size of the tile being installed, and selects tile spacers having a spacer arm width 20 which will produce the desired space. First, the surface 35, shown in FIG. 6*a*, to be tiled is cleaned and irregularities removed to produce a substantially flat and clean surface. Next, an adhesive composition is used to coat the surface to be tiled. The adhesive should have a sufficiently long cure time to allow the tile to be laid and adjusted as necessary. A first "course" or line of tiles 34, 34', 34" is laid and aligned, usually to a chalk line 37 or a laser beam generated by an electronic alignment device, or by a straight edge. A single arm of a tile spacer 10 of the present invention can be used to accurately create the correct sized space between, for example, adjacent tiles 34, 34' in this first course by simply pushing one arm down into the gap, between tiles 34, 34', so that two of the other arms span the top surface of the adjacent tiles, the bottom surface of tile spacer 10 is oriented towards the chalk line 37, the handle of tile spacer 10 bridges the top surface of both tiles 34, 34', and one arm extends upwards to provide a lever for removing the tile spacer 10 after all the tiles are installed. When the second and subsequent courses are laid, a tile spacer 10 is inserted at the intersection between each adjoining group of four tiles, so that one arm extends into the space between each two adjacent tiles of the four, to provide for automatic alignment of each end of the tile. Thus, as each course of tile is laid, use of the tile spacer 10 at the corners provide automatic alignment with the last course of tile laid. Accordingly, if the first course is carefully laid with respect to the chalk line, all remaining courses will be correct and aligned precisely. If it becomes necessary to adjust the first course slightly, this can be done with a straight edge. Since the handle or arm of a tile space 10 of the present invention provides a substantially flat surface, a straight edge may, if desired, be used to bear against all of the handles of the facing tile spacers to shift all or a plurality of tiles in the first course. When the adhesive composition cures, or when it has set up sufficiently to hold the tile in place, the tile spacers may be removed by simply pulling them out using the handle 12, or, in the case of the tile spacers used to space the tiles in the first course, by pulling up on the arm which extends upward. To finish the job, the installer need only fill the space between the tiles with grout.

Figure 7:
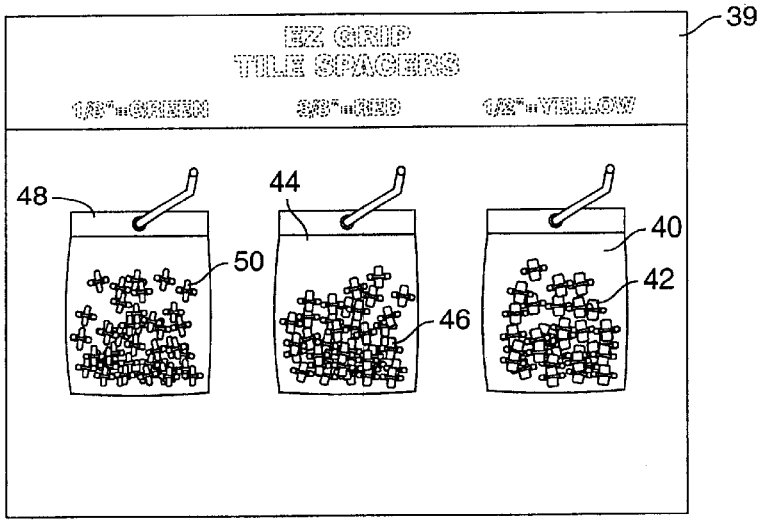

Because of the wide variety of tile sizes and styles available to the consumer, it will be necessary to offer tile spacers of the present invention in a variety of arm widths to produce a corresponding variety of predetermined space widths between the tiles. To make it easy for the consumer to select a desired arm width, I prefer to produce each different size tile spacer in a different color. Of course, it would be possible to paint the tile spacers to give them the proper color; however, as noted above, I prefer to produce the tile spacers from an injection molded stiff silicone which is available in wide variety of colors, so that the dimensions of the tile spacers will not be changed by adding a coating and so that the color cannot be inadvertently rubbed or worn off. Thus, for example, a spacer having a ⅛ inch arm width might be green, while a spacer having a ⅜ inch arm width might be red, and a spacer having a ½ inch arm width might be yellow. Such color coding will prevent mix-ups at the production facility, since it will be easy for quality control to visually spot a spacer which does not belong in a particular batch. Moreover, a plurality of like-colored spacers can be packaged and sold in clear plastic bags or other packaging through which consumers can see the color of the spacers. FIG. 7 shows an exemplary point of sale display 39, that includes a rack or shelves for displaying the different packages 40, 44, 48 of spacers 42, 46, 50. A preferred point of sale display 39 can also include a color chart showing the different sizes and their colors to provide immediate instructions to assist the consumers in choosing the right package.

One skilled in the art will recognize at once that it would be possible to construct the present invention from a variety of materials and in a variety of different ways. While the preferred embodiments have been described in detail, and shown in the accompanying drawings, it will be evident that various further modifications are possible without departing from the scope of the invention as set forth in the appended claims. Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A tile spacer, comprising:

a spacer body having extended spacer arms;

a substantially flat bottom surface established by said spacer body;

a first groove established in the bottom surface of said spacer body; and a second groove established in the bottom surface of said spacer body.

2. A tile spacer as in claim 1, wherein said spacer body defines a center and said first groove intersects said second groove at approximately the center of said spacer body.

3. A tile spacer as recited in claim 2:

wherein said spacer body forms a cross shape;

wherein said first groove intersects said second groove to form a cross-shaped groove that is radially offset from the cross-shaped spacer body by an angle of approximately forty five degrees.

4. A tile spacer as recited in claim 1, further comprising:

a handle extending from a top surface of said spacer body opposite said bottom surface of said spacer body.

5. A tile spacer as recited in claim 1, wherein said at least first groove is substantially configured in a "v" shaped cross section.

6. A tile spacer as recited in claim 1, wherein said at least first groove is substantially configured in a "u" shaped cross section.

7. A tile spacer as recited in claim 1, wherein said spacer body comprises interconnected spacer arms, each having a width configured for maintaining a desired spacing between tiles.

8. A tile spacer as recited in claim 7, wherein said at least first groove is positioned at the intersection of said spacer arms and is configured to form an adhesive bead between the corners of tiles being installed.

9. A tile spacer as recited in claim 7, further comprising a concavity at the intersection of said interconnected spacer arms.

10. A tile spacer as recited in claim 1, wherein said at least first groove is configured to have a width that is narrower than the width of said extended spacer arms.

11. In a tile spacer having a spacer body, formed by interconnected spacer arms of a desired width for maintaining a desired spacing between tiles, having a substantially flat bottom surface, the improvement comprising:

at least a first groove established within the flat bottom surface of the spacer body.

12. An improved tile spacer as recited in claim 11, wherein said at least first groove is positioned at the intersection of said interconnecting spacer arms and configured to form an adhesive bead between the corners of tiles being installed over an adhesive layer.

13. An improved tile spacer as recited in claim 11, wherein said at least first groove is configured to have a width that is narrower than the width of said spacer arms.

14. An improved tile spacer as recited in claim 11, further comprising a second groove established within the flat bottom surface of said spacer body.

15. An improved tile spacer as recited in claim 14, wherein said spacer body defines a center within which said first groove intersects said second groove at substantially the center of said spacer body.

16. An improved tile spacer as recited in claim 15, wherein said first groove intersects said second groove to form a cross-shaped groove that is radially offset from said interconnected spacer arms of said spacer body by an angle of approximately forty five degrees.

17. An improved tile spacer as recited in claim 11, wherein said at least first groove is substantially configured having a "v" shaped cross section.

18. An improved tile spacer as recited in claim 11, wherein said at least first groove is substantially configured having a "u" shaped cross section.

19. An improved tile spacer as recited in claim 11, further comprising a concavity at the intersection of said interconnected spacer arms.

20. A tile spacer for maintaining spacing between corners of adjacent tiles during installation, comprising:

a spacer body having extended spacer arms;

a substantially flat bottom surface established by the spacer body; and means for establishing a raised bead of adhesive between the corners of the tiles.

21. A tile spacer as recited in claim 20, wherein said means for establishing said raised bead of adhesive comprises:

at least a first groove established within said flat bottom surface of said spacer body.

22. A tile spacer as recited in claim 21, wherein said means for establishing said raised bead of adhesive further comprises:

at least a second groove established within said flat bottom surface.

23. A tile spacer as recited in claim 22, wherein said spacer body defines a center and said first groove intersects said second groove at substantially the center of said spacer body.

24. A tile spacer as recited in claim 23, wherein said first groove intersects said second groove to form a cross-shaped groove that is radially offset from the extended arms of said spacer body by an angle of approximately forty five degrees.

25. A tile spacer as recited in claim 23, further comprising:

a handle extending from said spacer body from a side opposite said first and second grooves.

26. A tile spacer as recited in claim 20, wherein said at least first groove is substantially configured in a "v" shaped cross section.

27. A tile spacer as recited in claim 20, wherein said at least first groove is substantially configured in a "u" shaped cross section.

28. A tile spacer as recited in claim 20, further comprising a concavity at the intersection of said spacer arms within said spacer body.

29. A tile spacer, comprising:

a spacer body having extended spacer arms;

a substantially flat bottom surface established by said spacer body; and at least a first groove established in said bottom surface of said spacer body.

30. A tile spacer as recited in claim 29, further comprising:

at least a second groove established in the bottom surface of the spacer body.

31. A tile spacer as recited in claim 29, wherein the intersection of said extended arms within said spacer body form a cross-shaped spacer having a center in which said first groove intersects said second groove.

32. A tile spacer as recited in claim 31, wherein said first groove intersects said second groove to form a cross-shaped groove that is radially offset from said cross-shaped spacer body by an angle of approximately forty five degrees.

33. A tile spacer as recited in claim 29, further comprising:

a handle extending from said spacer body in a direction opposite said bottom surface of said spacer body.

34. A tile spacer as recited in claim 29, wherein said at least first groove is configured with a "v" shaped cross section.

35. A tile spacer as recited in claim 29, wherein said at least first groove is configured with a "u" shaped cross section.

36. A tile spacer as recited in claim 29, wherein said at least first groove is configured to have a width that is narrower than the width of said extended arms of said spacer body.

37. A tile spacer as recited in claim 29, further comprising a concavity at the intersection of said spacer arms within said spacer body.

* * * * *